US006612251B1

(12) United States Patent
Ness

(10) Patent No.: US 6,612,251 B1
(45) Date of Patent: Sep. 2, 2003

(54) MOBILE UNDERSEA HABITAT

(76) Inventor: C. Clifford Ness, 11 Willow La., East Lyme, CT (US) 06333

( * ) Notice: Subject to any disclaimer, the term of this patent is extended or adjusted under 35 U.S.C. 154(b) by 3 days.

(21) Appl. No.: 10/112,379

(22) Filed: Mar. 29, 2002

(51) Int. Cl.[7] ..... B63B 35/00; B63C 11/10
(52) U.S. Cl. ..... 114/66; 405/192
(58) Field of Search ..... 114/66, 258, 312, 114/313, 314, 322, 323, 324, 325, 342; 405/192, 194

(56) References Cited

U.S. PATENT DOCUMENTS

| | | | | | |
|---|---|---|---|---|---|
| 683,361 | A | * | 9/1901 | Watson | 405/194 |
| 760,457 | A | * | 5/1904 | Lake | 405/192 |
| 1,048,194 | A | * | 12/1912 | Mitchell | 405/10 |
| 1,356,773 | A | * | 10/1920 | Lake | 405/192 |
| 1,997,149 | A | | 4/1935 | Lake | |
| 2,980,047 | A | | 4/1961 | Korganoff et al. | |
| 3,299,645 | A | | 1/1967 | Link | |
| 3,379,157 | A | * | 4/1968 | Post | 114/66 |
| 3,613,621 | A | * | 10/1971 | McKinley et al. | 114/66 |
| 3,883,910 | A | * | 5/1975 | Naylor, III | 114/355 |
| 4,087,980 | A | | 5/1978 | Kono | |
| 4,276,851 | A | | 7/1981 | Coleman | |
| 5,117,774 | A | * | 6/1992 | English et al. | 114/66 |
| 5,477,798 | A | | 12/1995 | Ness | |

FOREIGN PATENT DOCUMENTS

| | | |
|---|---|---|
| JP | 57-87786 | 6/1982 |

* cited by examiner

*Primary Examiner*—S. Joseph Morano
*Assistant Examiner*—Andrew Wright

(57) ABSTRACT

A mobile undersea habitat includes an elongated vessel having a hull providing an elongated recess opening downwardly to the sea, and a cooperatively dimensioned elongated column seated within the recess. The column includes an elongated structural member with a conduit extending along its length and an elongated panel providing a closure for the hull opening which also functions as a support member in the column. A support member pivotally mounts one end of the support member in the hull, and a pivot pivotally mounts one end of the structural member in the hull at a point spaced from the support member pivot. A habitat is provided at the other end of the column and it is pivotally mounted to the structural and support member so that it maintains a horizontal attitude at any angular portion of the column. The conduit provides a passage from the vessel to the habitat in which a transport capsule carries personnel and supplies.

20 Claims, 8 Drawing Sheets

MOBILE UNDERSEA HABITAT

BACKGROUND OF THE INVENTION

The present invention relates to undersea habitats for personnel and, more particularly, to such habitats that may be transported from site to site.

In the beginning, God created heaven and earth, and granted man "dominion over the fish of the sea, the birds of the air, and over every living thing that moves upon the earth". Since then, with minimal success, man has endeavored to fulfill that mandate to have dominion over the sea. However, only in the past century has man progressed to achieve prolonged habitation in the waters which cover two thirds of our planet. It is most important to recognize that seventy percent of earth's natural resources remain submerged. Perhaps the greatest challenge to continued underwater presence is the interface of air and sea where constant storms, icing, and tidal waves threaten all existence. Man is unequipped, when compared with aquatic mammals, to independently achieve a sustainable air supply in, or withstand the pressure of, ocean depths. Submarines including deep sea submersibles represent the most widely employed habitats presently available and provide limited ability for man to work at substantial depths. Only by providing a relatively stationary shelter within the sea, can there be sustained habitation so that personnel can work at substantial depths, and such a habitat must minimally provide ease of access, heat, sustenance, air replenishment, and communication with the surface. Three differing means of current art are now employed in effecting such a presence:

a. a structure affixed to the sea bottom b. a cable lowered structure from a surface vessel c. a mobile and submersible self-contained structure.

Each of these provides a measure of successful under sea presence, but each has limitations.

The fixed shelter is costly, is not easily repositioned, is difficult to maintain and repair, is dependent on its surface platform for power and sustenance, requires additional vessels to enlarge its area of search and survey, and has difficulties in transit from shelter to surface.

Although transportable, a cable lowered shelter lacks endurance because of the dependence on good weather, and it requires the same continuous supporting services. Its expense, the hazards of operation, and the need for portability limit both the habitat size and capability. This type of habitat is perhaps least able to provide safety and comfort.

The self-contained underwater vessel has advantages of mobility, independence from the surface, and lower operating costs. The submarine-type platform enables convenience of inspection, maintenance, and repair. However, as a habitat it has a limitation on ability to remain on site, suffers from a loss of communication, needs to resurface for replenishment of power and air supplies, and has restricted volume for stowage as needed for a sustained on-site presence.

Another habitat employs a ballast-induced rotation of a surface vessel into a vertical position. This is found to have an exaggerated motion in that position, as does a spar buoy, and there are difficulties with compartment reorientation from horizontal to vertical. Its ample stowage is also diminished by that shift of axis. The hydrodynamics of hull form are compromised by its design, and a return to port is required (and frequently dry-dock) for inspection, maintenance and repair. The acquisition costs, while less than for a bottom fixed shelter, are estimated to be greater than those for a self contained fixed shelter.

One significant purpose for all underwater habitats is the support and monitoring of divers entering into the water. While experimental diving has been successfully extended to 600 meters, the practical safe limits are but half of that. The transit of the diver from the surface is lengthy and hazardous, and the diver has a significantly limited bottom time which degrades with increasing depth. The time required to decompress also increases greatly as depth is increased, with a duration which may be measured in days.

Current efforts to harvest the sea's resources by collecting marine samples and by performing archeological surveys in land salvage from the sea floor, have for reasons of lower cost and safety, resulted in the employment of unmanned remotely operated or autonomous vehicles. These vehicles, however, are regarded by some as inadequate, particularly when long term observation is required. Marine creatures are inclined to disperse from any intrusion upon their habitat. Tides and time of day can also vary both the presence and behavior of the aquatic life.

It is an object of the present invention to provide a novel movable undersea habitat which enables stays of long duration and which is readily movable from site to site.

It is also an object to provide such a mobile undersea habitat which includes an elongated support structure from the transport vessel and convenient means for access to and return from the habitat.

Another object is to provide such a mobile undersea habitat in which the habitat can be retrieved relatively quickly if required and the habitat is capable of self-contained operation for a reasonably extended period of time in the event of interruption of support systems from the transport vessel.

A further object is to provide such a mobile undersea habitat which can be fabricated relatively easily and economically from an existing vessel.

SUMMARY OF THE INVENTION

It has now been found that the foregoing and related objects can be readily attained by a mobile undersea habitat which includes an elongated vessel having a hull providing an elongated recess opening downwardly to the sea. A cooperatively dimensioned elongated column is seated within the recess and includes an elongated structural member and an elongated support member which extends in parallel spaced relationship to the structural member and means couple the support member to the structural member at spaced points along the length thereof. A conduit extends along the length of the structural member and is supported thereby. Support member pivot means pivotally mounts one end of the support member in the hull, and structural member pivot means pivotally mounts one end of the structural member in the hull at a point spaced from the support member pivot means. Also provided is means for raising and lowering the other end of the column.

An entrance is provided into the upper end of the conduit whereby persons and material may be moved therethrough, and a habitat is provided at the other end of the column and conduit. The habitat has a first passage to the conduit and a second passage to the exterior. The habitat is supported on a platform portion provided at the other end of the support member. Platform pivot means pivotally mounts the platform portion to the body of the support member, and habitat pivot means pivotally mounts the habitat to the other end of the conduit and structural member for movement about a pivot axis relative to the structural member. The platform and habitat pivot means together with the pivots to the hull cooperate to provide a horizontal orientation for the habitat at various angular orientations of the column.

The support member provides a hull closure panel for the opening in the hull when the column is pivoted upwardly into the opening. The support member is monolithic over its length to said platform portion. The structural member is a box-like girder extending about said conduit and there are also disposed in the girder cables and piping between the vessel and the habitat.

The coupling means comprises a multiplicity of supporting links spaced along the length of the structural member and support member, and link pivot means pivotally mount the ends of the links to the structural and support members. Desirably, hydraulic snubbers are provided adjacent the habitat between the support and structural members. The platform portion is a portion of the support member and the platform pivot means is provided therebetween.

A transport capsule is movable within the conduit for transportation of persons and material, and there is included means for moving the capsule between the vessel and the habitat. The habitat pivot means includes cooperating and interfitting generally cylindrical elements on the conduit and the habitat.

At least one ballast chamber is provided on the column adjacent the habitat to control the buoyancy of the assembly of the column, conduit and habitat and thereby the angular orientation of the assembly relative to the vessel. Also included is means to admit water to the ballast chamber and means to expel water from the ballast chamber to achieve the desired buoyancy.

Preferably, the habitat includes a diving bell access hatch. Cables are connected between the hull and the support member adjacent the habitat to provide means for retracting the column, into the hull opening and winches pay out and retrieve the cables. A multiplicity of cables and tubes or pipes extend from the vessel to provide breathable gas, water, heat, communications and power to the habitat. Emergency air supply tanks are supported on the column adjacent the habitat for supply of breathable gas thereto.

Desirably, the habitat includes a cluster of interconnected spheroidal chambers. A gallery is provided about the upper end of the habitat and the lower end of the conduit for access to the conduit from a plurality of the spheroidal elements.

The spacing between the pivots at the upper end of the structural and support members is substantially the same as the spacing between the pivots at the lower ends of the spherical and support members, whereby the ends of the structural and support members define a parallelogram to orient the platform portion and habitat in a horizontal attitude.

Generally, the pivot axis of the structural member is spaced horizontally and upwardly from that of the support member.

DETAILED DESCRIPTION OF THE PREFERRED EMBODIMENT

Figure 1:
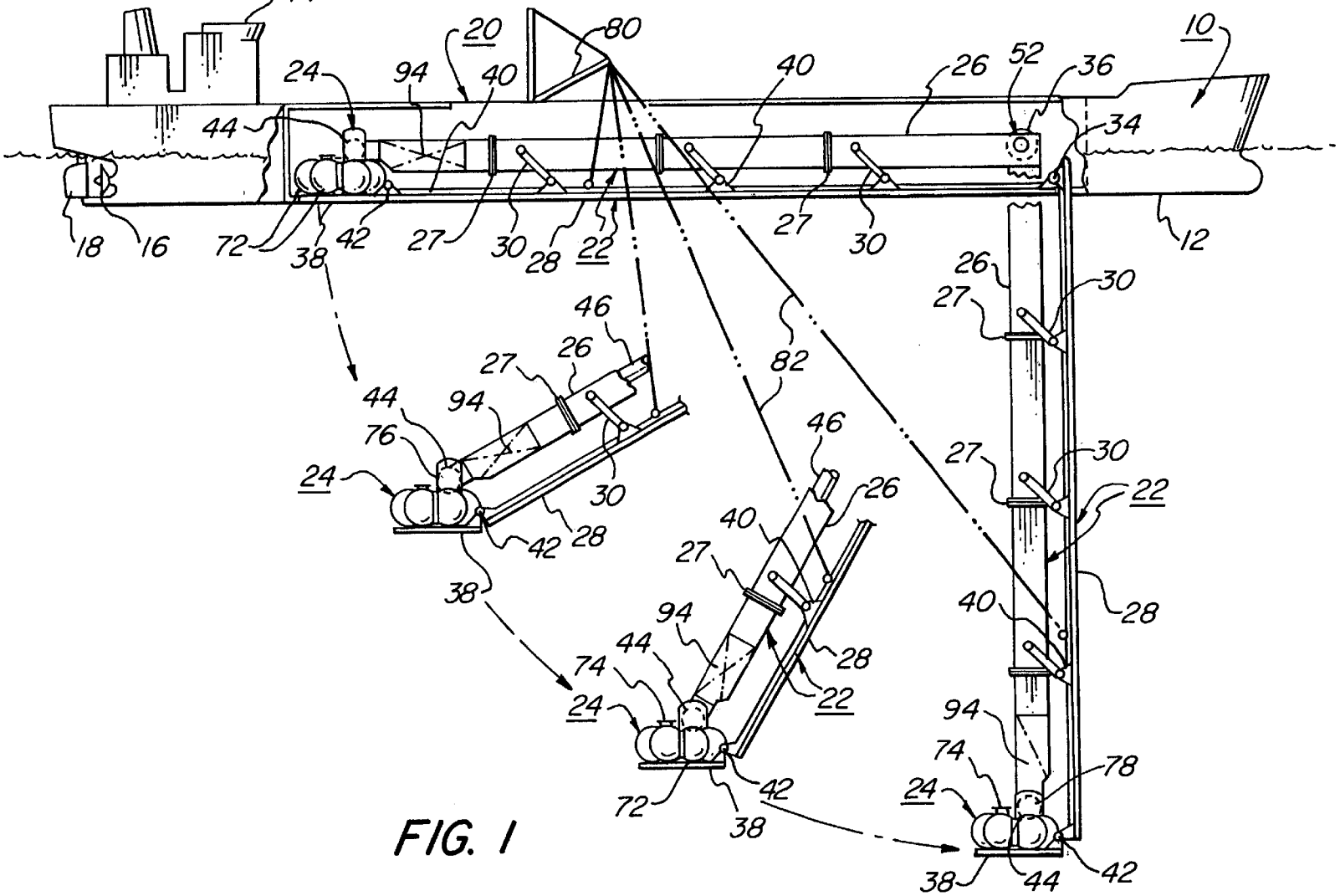
FIG. 1 is a diagrammatic illustration of a mobile undersea habitat embodying the present invention showing the column and habitat (i) indisposed within the hull of the transport vessel shown in phantom line, (ii) fully deployed in a vertical position and (iii) displayed in two angular positions.

Turning first to FIG. 1, therein illustrated diagrammatically is an elongated transport vessel generally designated by the numeral 10 and having a hull 12, superstructure 14, propulsion screw 16 and rudder 18. The hull 12 has a elongated cavity 20 in which is disposed a column generally designated by the numeral 22 and the habitat generally designated by the numeral 24. The column 22 is comprised of the box girder 26 and the elongated panel and support member 28 which is coupled to the box girder 26 by the links 30 to provide a rigid column 22. Extending within the box girder 26 between the vessel 10 and the habitat 24 is a tubular conduit 32. When the vessel 10 is moving to or from a site, the opening in the hull 12 is closed by the panel and support member 28.

The upper end of the panel 28 is pivotably supported in the hull 12 at the pivot 34 and the upper end of the girder 26 is pivotably supported in the hull at the pivot 36. The habitat 24 is pivotably supported at the lower or other end of the column 22 on the platform portion 38 of the panel 28. The platform portion 38 is pivotably connected to the body 40 of the panel 28 by the pivot 42. The pivoting links 30 between the girder 26 and panel 28 and the pivotal connection of the girder 26 to the pivoting platform portion 38 allow the habitat 24 to assume a horizontal attitude at all angular positions of the column 22 and panel 28. A pivotal connection between the habitat 24 and the girder 26 is provided at pivot point 44.

As also seen in FIG. 1, a pair of deck booms 80 are provided on port and starboard sides of the vessel 10 and cables 82 extend therefrom and are connected to the panel 28. These may be used to raise and lower the column 22 and habitat 24.

Figure 2:
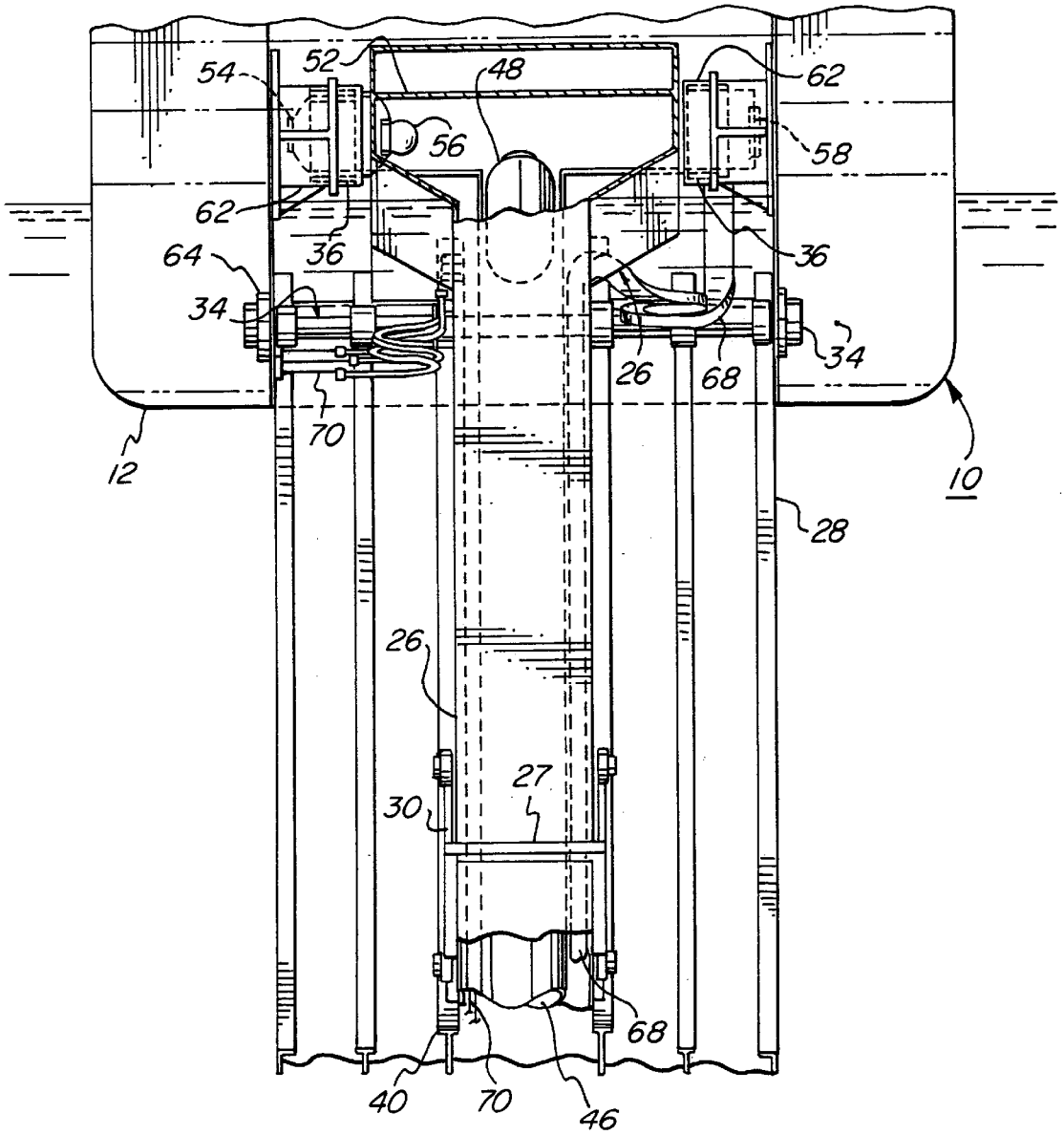
FIG. 2 is an enlarged fragmentary cross sectional view of the vessel showing in partial section the mounting of the upper end of the fragmentarily illustrated column, a pressure chamber and access to the transport capsule.
Figure 3:
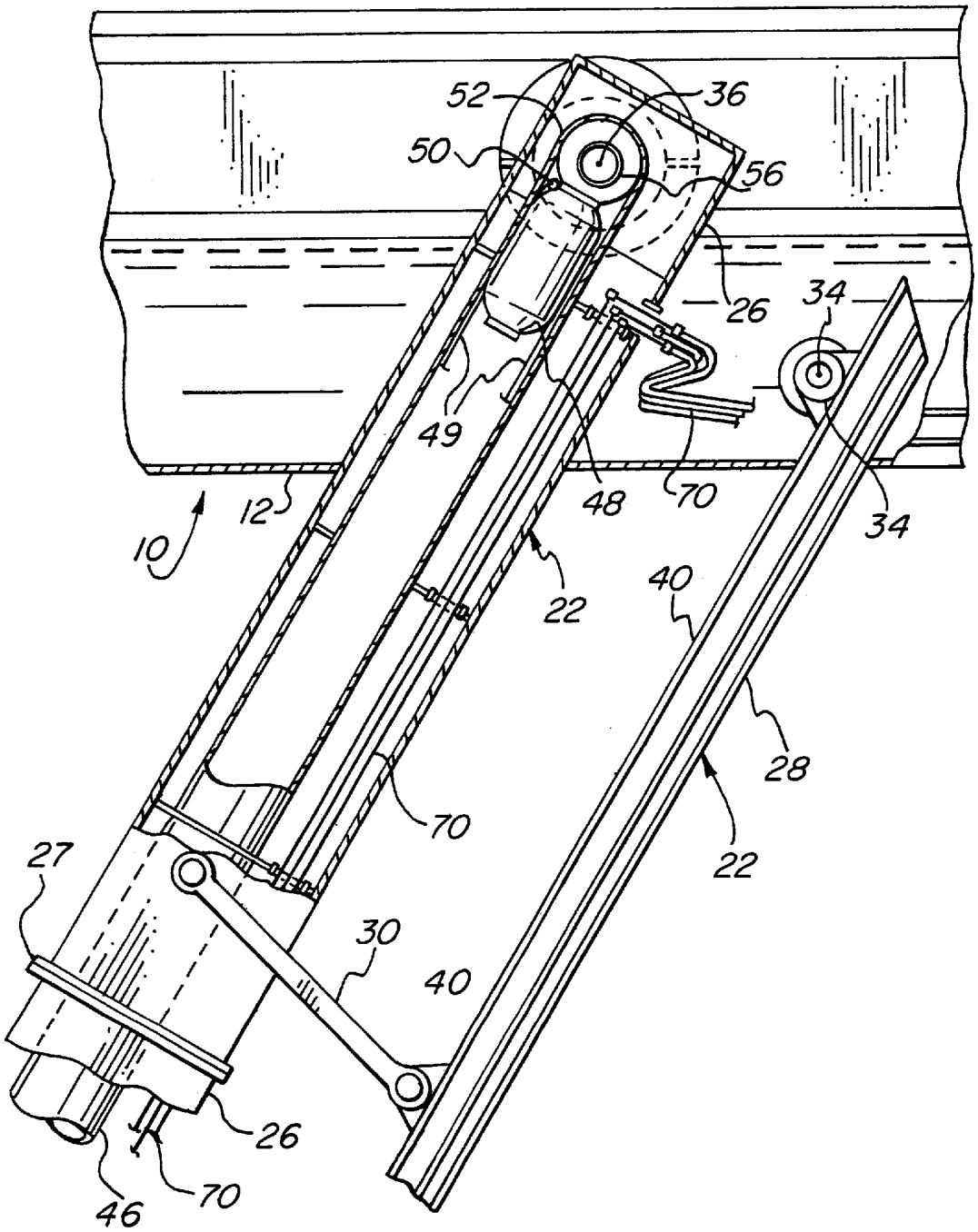
FIG. 3 is a fragmentary side elevational view in partial section of the upper end of the column and its support within the hull.
Figure 8:
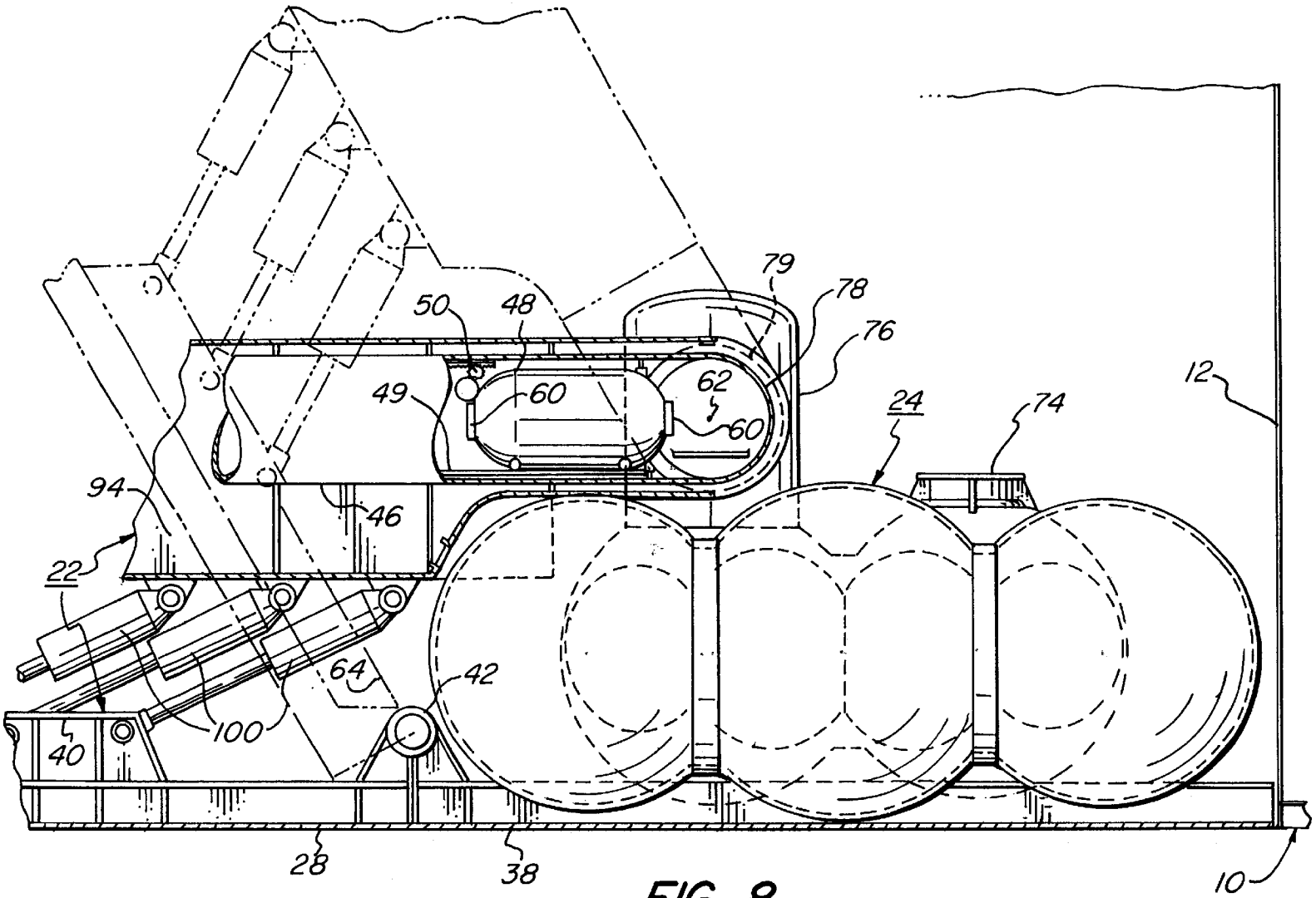
FIG. 8 is an enlarged side elevational view of the habitat and fragmentarily illustrated column in solid line as stored in the hull and in phantom line as deployed at an angle of 60°.

Turning now in detail to the structural assembly at the upper end of the column and vessel, reference is made to FIGS. 2, 3 and 8. The girder 26 is assembled from a series of sections which are joined at flanges 27. As seen, there is disposed within the girder 26 a tubular conduit 46 in which a transport capsule 48 moves between the vessel 10 and the habitat 24 for the movement of personnel and supplies. Controlled movement of the capsule 48 along the guide rails 49 is effected by the cog drive 50 seen in FIG. 8. The upper end of the conduit 32 terminates in a transverse conduit 52 which communicates with a compression chamber 54 at one end. Hatches 56, 58 are provided at either end of the conduit 52, and a hatch 60 is provided in the capsule 48. Trunnion bearings 62 in which the conduit 52 is seated provide the pivot 36 for the girder 26, and bearings 64 provide the pivot 34 for the panel 28.

Also disposed within the girders 26 is a chase 66 to carry the cables 68 for power supply and communications and a chase 67 for the tubing to carry oxygen, helium, water and waste.

Turning next to FIGS. 4–8, the habitat 24 is comprised of a series of interconnected spheroidal elements 72, two of which are provided with a diving bell hatch 74. On the spheroidal elements 72*a,* 72*b* are towers 76 between which extends a tubular gallery 78 which is pivotably seated therein on bearings and seals 79 and which is coupled to the lower end of the conduit 46. This provides the pivotable connection between the conduit 46 and the habitat 24. Hatches (not shown) are provided between the towers 76 and the spheroidal elements 2 and between the gallery 78 and the conduit 46. Desirably, hatches and pressure chambers (not shown) are provided between a first group of spheroidal elements 72 in which the atmosphere pressure is equal to that of the external environment and a second group in which the pressure is equal to that at the surface.

Figure 7:
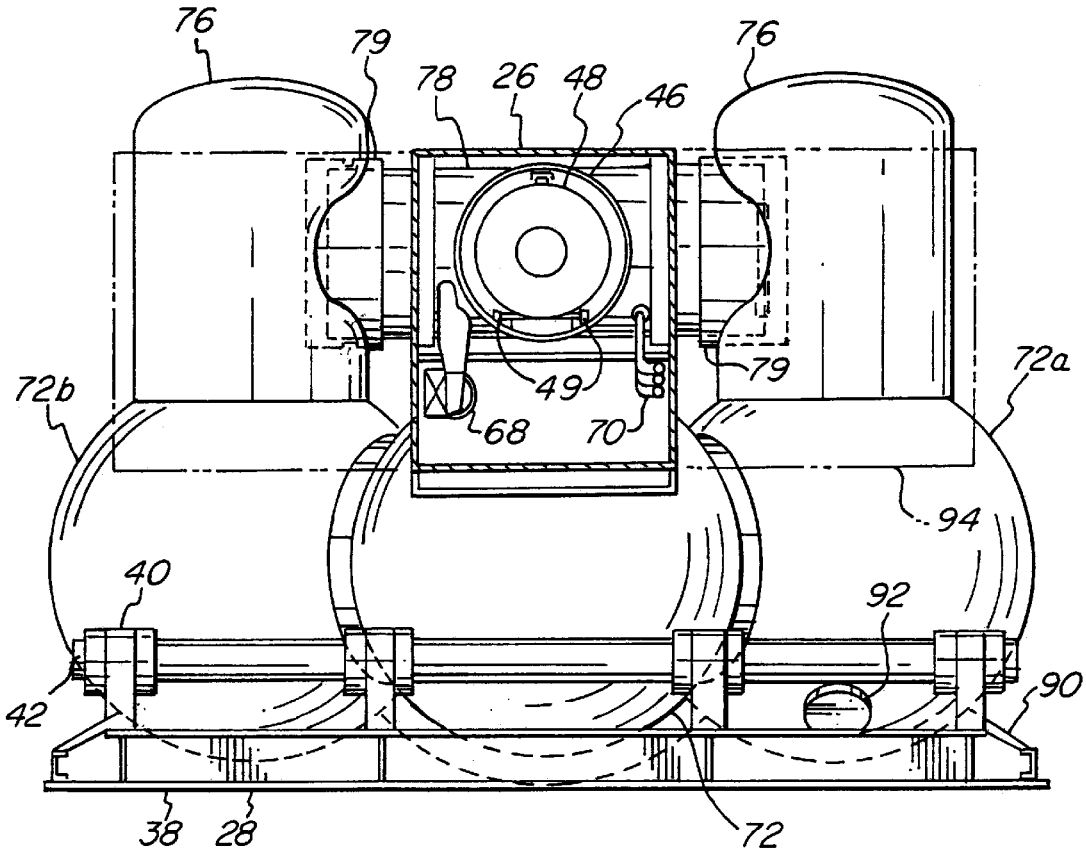
FIG. 7 is a side elevational view of the habitat and gallery.

The spheroidal elements 72 are firmly secured on the pedestals 90 on the platform portion 38. The cables 68 and tubes 70 enter the habitat 24 through high pressure seals (not shown). Also seen in FIG. 7 is a diver hatch 92.

Figure 4:
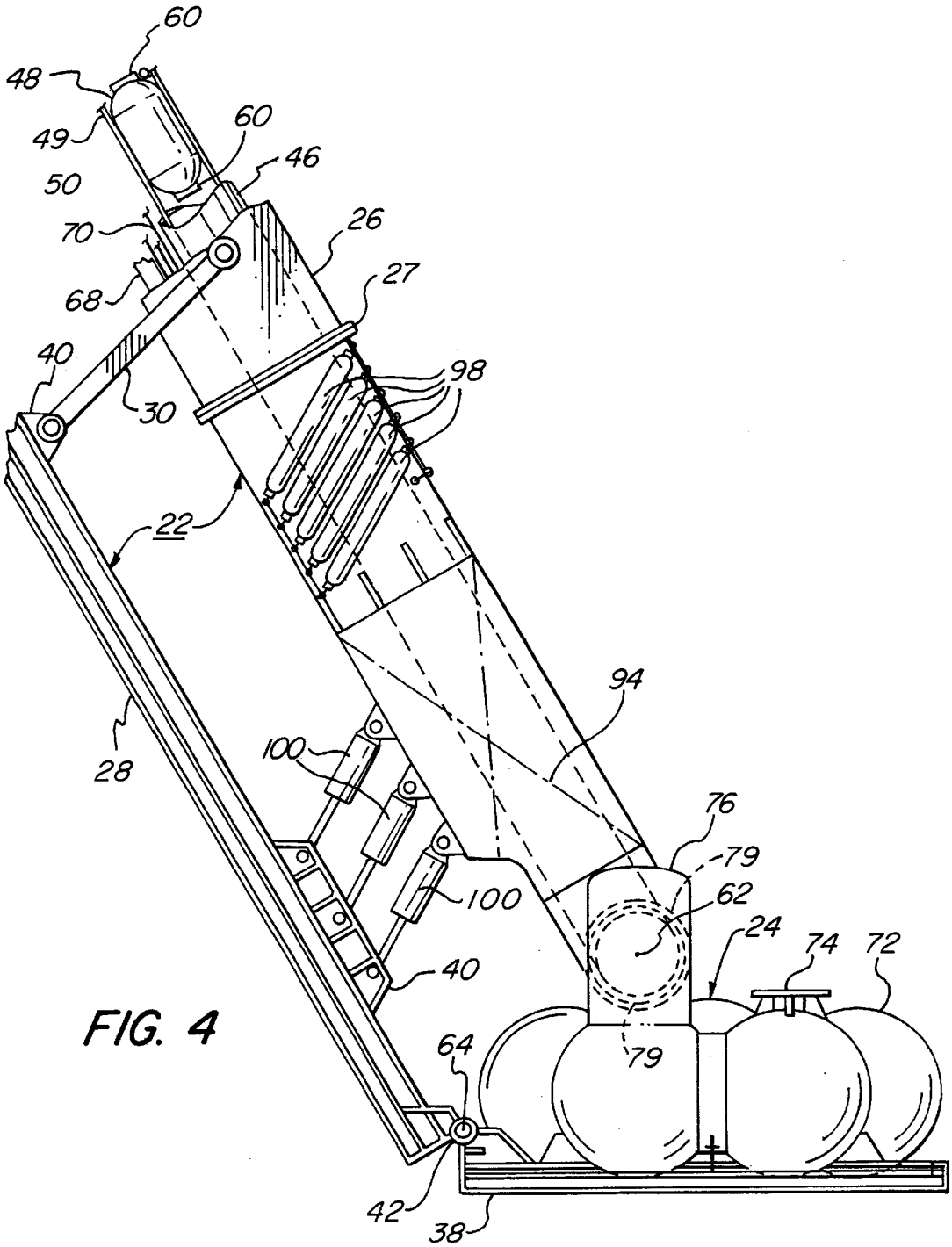
FIG. 4 is an enlarged side elevational view of the lower end of the column and habitat.
Figure 5:
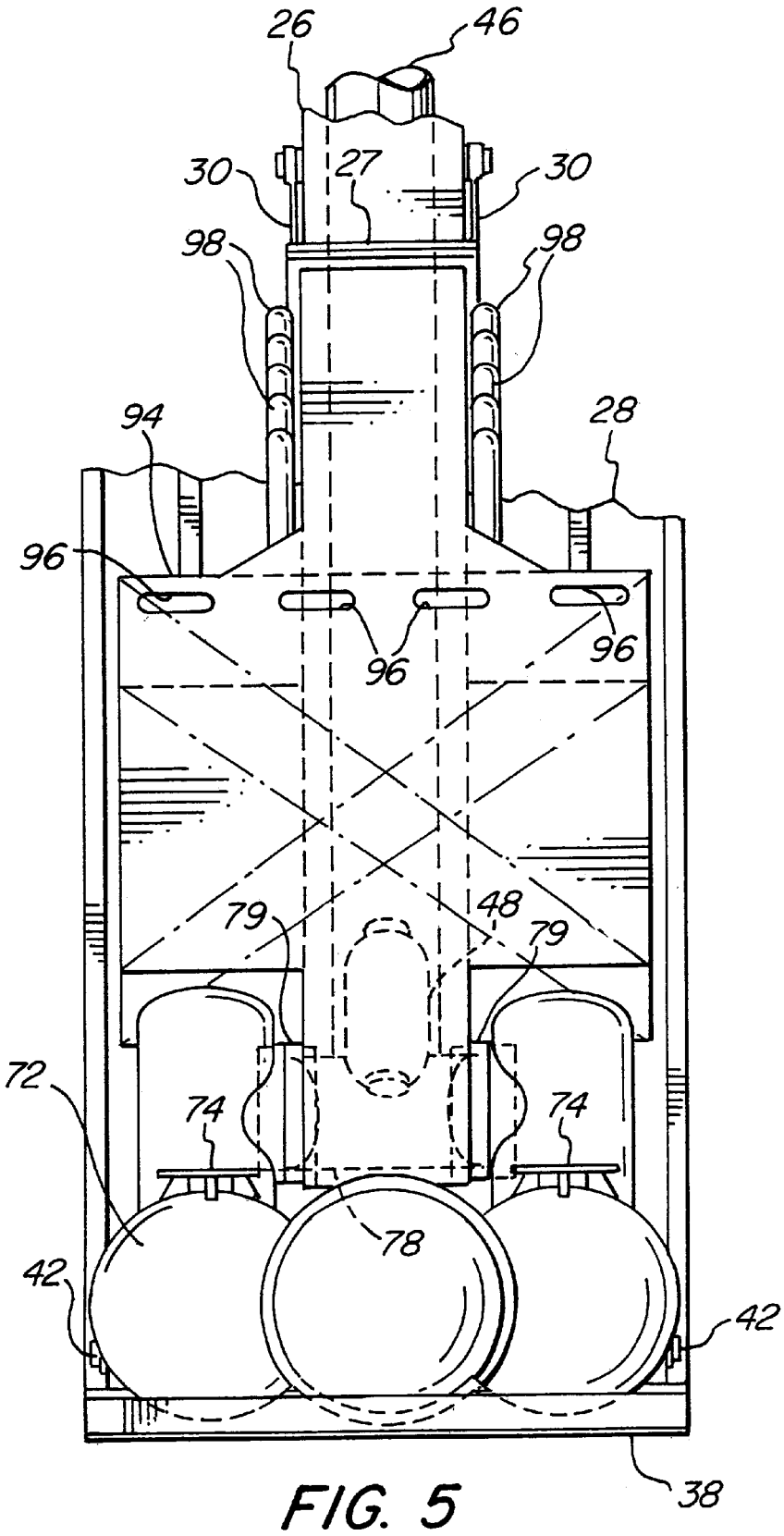
FIG. 5 is a front elevational view thereof.
Figure 6:
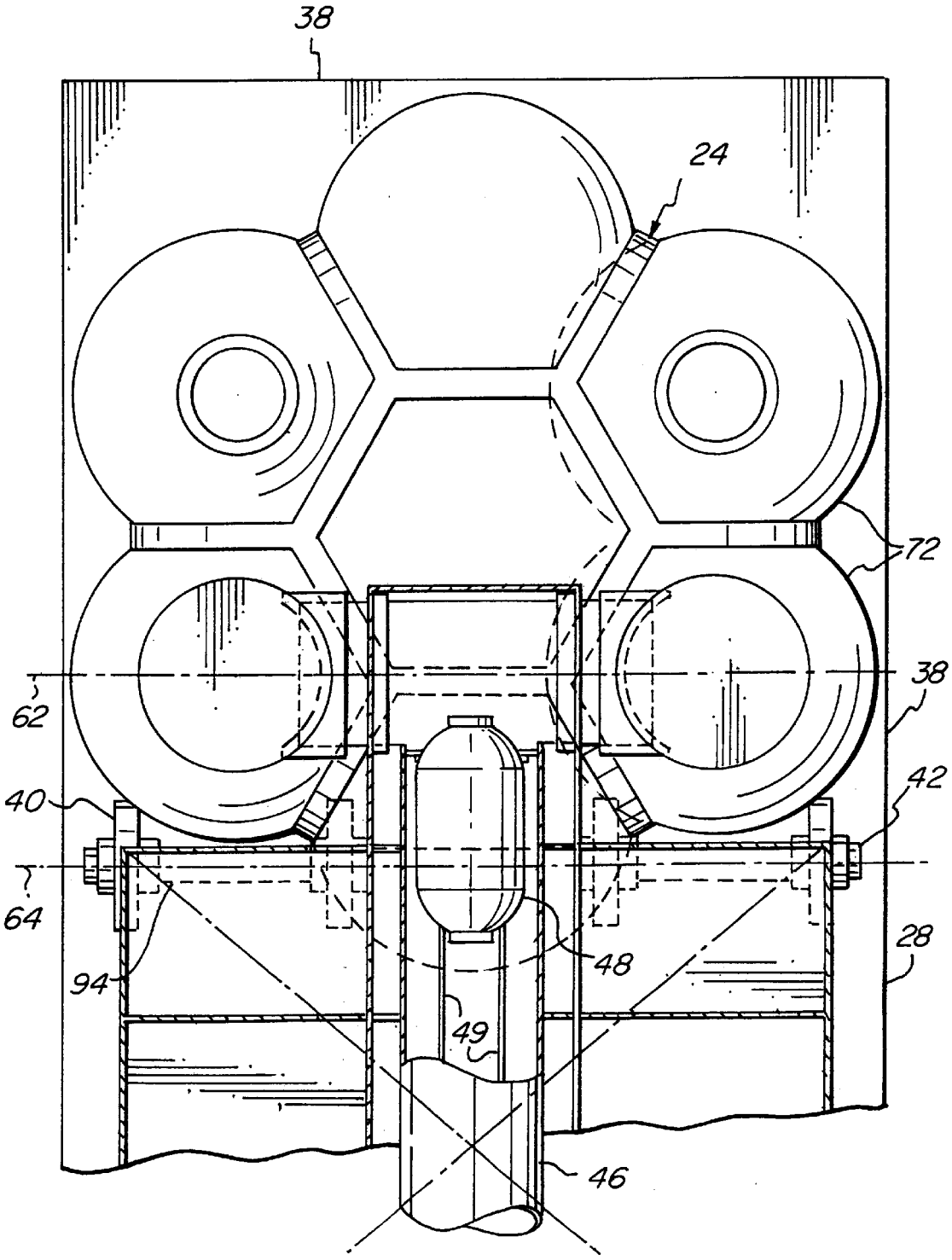
FIG. 6 is an enlarged plan view of the gallery and habitat and the fragmentarily illustrated column and transport capsule.

As seen in FIGS. 4 and 5, ballast tanks 94 with valves 96 are supported on the girder 26 above the habitat 24, and the buoyancy of the habitat 24 and column 22 can be adjusted by admitting or discharging water from the tanks 94 to raise and lower the column 22 and habitat 24. High pressure gas flasks 98 supported on the girder 26 provide the air pressure to discharge water from the tanks 94. Snubbers 100 are provided between the lower section of the girder 26 and the panel 28 for stability.

In operation at a selected site, the divers will be acclimated to the desired pressure in a compression chamber (not shown) on the vessel 10 connected to the compression chamber 54. Although they may work their way into the habitat 24 through the transport capsule 48 or through the hatches in the habitat 24, it is preferable that the column 22 and habitat 24 be deployed first. Lowering of the column 22 is initially effected by lowering the cables 82. After the ballast tanks 94 are in the water, valves may be opened to allow water to enter the tanks 94 which decreases the buoyancy of the column 22 and habitat 24, thus causing them to gradually pivot downwardly as the cables 82 are payed out. Because the spacing between the upper pivots 34, 36 and the spacing between the trunnion bearing 62 and the panel bearing 64 are equal, the assembly of the girder 26, panel 28, upper pivots 34, 36 and lower pivots 62, 64 acts as a parallelogram and the platform portion 38 and habitat 24 are always in a substantially horizontal attitude.

If the water depth is less than the length of the column 22, the platform portion 38 and habitat 24 may seat on the bottom, but it is preferable to space the platform 38 upwardly a distance of 20–50 feet above the bottom to avoid undue stress and impacts in the event of violent sea action.

To raise the column 22 and habitat 24, the process is reversed. Water is expelled from the ballast tanks 94 by pressurized air from the flasks 98 and the buoyancy will cause the column 22 to pivot about the pivots 34 and 36 and rise as the cables 82 are wound about the take up drums (not shown). The final movement into the hull 12 can be assisted by the cables 82.

After the habitat 24 has been lowered into position, personnel may be transported to and from it by the transport capsule 48. Conditioned divers enter from the compression chamber 54 through the hatch 60 into the capsule 48 which has been pressurized. Personnel who will live and work in the low pressure side of the habitat 24 enter through the hatch 58 into the capsule which is not pressurized for their use.

The capsule 48 travels downwardly in the conduit 46 on the guide rails 49 by the cog drive 50. When the capsule 48 seats against the seals in the gallery 78, personnel may exit the capsule 48 into the gallery 78, which is pressurized or not depending upon the state of the personnel and they pass through a hatch into the tower 76 of the appropriate section of the habitat 24.

As will be readily appreciated, the capsule 60 also carries food and other supplies for the crew in the two sections of the habitat thus reducing the area required for storage. Power, air, oxygen, helium, water, waste and communications are effected through the cables and tubes which extend from the vessel 10 to the habitat 24. However, emergency power, water and air supplies are provided in the habitat 24.

Thus, it can be seen that the column can be pivotally mounted in an existing surface vessel, and it provides a leveraged structural assembly that maintains a horizontal habitable platform throughout its full range of deployment down to a vertical position of the column. Its movement is basically operated by a variable displacement ballast controlled system, supplemented by winches, and protected by snubbers. The elements of the column form a parallelogram to achieve the stable horizontal attitude for the habitat at various angular positions of the column. The trunnion supported box girder in concert with the hinging of the vessel's bottom panel, and connection thereto establish a robust structure for locating the habitable platform considerably below the surface of the sea. Incorporated into the design are a multiplicity of pivoted links for stabilizing the unsupported length of the extended structure at a spacing of approximate thirty meters.

The connecting access is contained within the girder, and it includes an enclosed pressure adjustable capsule for the transport of personnel and material to the habitat. The necessary supply lines for electrical and hydraulic power, fluids, gases, food and other consumables is contained within this girder structure. The services of communication, positioning, maintenance, manning, stowage, anchorage, and relocation exist in the surface vessel which may be modified for the present assembly. This complement of capabilities enables an extended duration for undersea presence.

When surface conditions create significant forces and stresses upon the structural attachments to the vessel, and within the extended structure, the design will act as a keel to stabilize pitch and roll, thereby improving the stability and safety of the vessel. The truss design of the hinged column accommodates athawrtship loadings on the extended column and habitat, and the cross-section of the girder elements is sized to accommodate those loads in both vertical and longitudinal directions.

Trunnion design, as used in shipboard gun turrets, is adequate for the pivotal mountings for the present application. Hydraulic snubbers of a type used on aircraft landing gear are incorporated adjacent the outer extreme of the extended column and permit full extension, but restrain all rapid motion.

The movable habitat of the present invention is able to perform the insertion of man into the sea for functions such as underwater dredging, undersea drilling, and the laying of trans-oceanic cables which might not require inhabitation, but the habitat's adaptability may enable superior performance of those functions. A more stable platform located below the surface extends the weather window for many search and survey operations, and it shortens the tether on a deployed unmanned vehicle while extending its search range. The use of this innovative platform for archeological search, salvage, and recovery would be of incalculable advantage as it enables a prolonged and sustainable presence at the site.

The habitat is independent of the sea bottom which is a distinct advantage when monitoring fragile environments, since any contact would cause damage or destruction. The submerged platform's proximity enables visual control for the search, salvage and recovery at a marine disaster site, and immeasurably improves current capability. All operations that require divers in the sea could benefit from the improved safety and support provided by this mobile habitat. The ability to house dive teams at depth, and employ them continuously for twenty-four hours daily, reduces the cost to a fraction of that presently required for many operations.

Accordingly, it can be seen that the mobile undersea habitat of the present invention provides an improved platform for prolonged submersion of divers at moderate depths and enables facile provision of consumables, power, gases, etc., from the transport ship. The assembly utilizes a water ballast system for stability and it enables relatively rapid deployment and quick retrieval if required.

Having this described the invention, what is claimed is:

1. A mobile undersea habitat comprising:

a. an elongated vessel having a hull providing an elongated recess opening downwardly to the sea;

b. an elongated column with first and second ends and cooperatively dimensioned to seat within said recess, said column including an elongated structural member and an elongated support member extending parallel to and spaced from said structural member, said structural and support members each having first and second ends adjacent said first and second ends of said column;

c. a conduit extending along the length of said structural member and supported thereby;

d. means coupling said support member to said structural member at spaced points along the length thereof;

e. support member pivot means pivotally mounting said first end of said support member in said hull;

f. structural member pivot means pivotably mounting said first end of said structural member in said hull at a point spaced from said support member pivot means;

g. means for raising and lowering said second ends of said support member and structural member;

h. an entrance into said conduit at said first end of said structural member whereby persons and material may be moved therethrough;

i. a habitat at said second end of said structural member and conduit, said habitat having an upper end with a first passage to said conduit and a second passage to the environment external to said habitat, said habitat being supported on a platform portion provided at said second end of said support member;

j. platform pivot means pivotally mounting said platform portion to said support member; and k. habitat pivot means pivotally mounting said habitat on said second end of said conduit and structural member for movement about a pivot axis relative to said conduit, said platform pivot means and habitat pivot means together with said support member pivot means at said first end of said structural and support members providing a horizontal orientation of said habitat at various angular orientations of said column.

2. The mobile undersea habitat in accordance with claim 1 wherein said support member provides a hull closure panel for said opening in said hull when said column is pivoted upwardly into said opening.

3. The mobile undersea habitat in accordance with claim 2 wherein said support member is monolithic over its length from said first end to said platform portion.

4. The mobile undersea habitat in accordance with claim 3 wherein said structural member is a box-like girder extending about said conduit and wherein there are also disposed in said girder cables and piping between said vessel and said habitat.

5. The mobile undersea habitat in accordance with claim 4 wherein there are included a multiplicity of tubes and communication and power supply cables, said tubes and cables providing breathable atmosphere, water, heat, communications, and power to said habitat.

6. The mobile undersea habitat in accordance with claim 4 wherein said coupling means comprise a multiplicity of supporting links spaced along the length of said structural member, and link pivot means pivotally mounting the ends of said links to said structural and support member.

7. The mobile undersea habitat in accordance with claim 6 wherein there are included hydraulic snubbers between said support member and structural member adjacent said habitat.

8. The mobile undersea habitat in accordance with claim 1 wherein said platform portion is provided as a continuation of said support member and wherein said platform pivot means is provided therebetween.

9. The mobile undersea habitat in accordance with claim 1 wherein there is included a transport capsule movable within said conduit for transportation of persons and material.

10. The mobile undersea habitat in accordance with claim 9 wherein there is included means for moving said capsule between said vessel and said habitat.

11. The mobile undersea habitat in accordance with claim 1 wherein said habitat pivot means includes cooperating and interfitting generally cylindrical elements on said conduit and said habitat.

12. The mobile undersea habitat in accordance with claim 1 wherein there is included at least one ballast chamber on said column adjacent said habitat to control the buoyancy of said column and thereby the angular orientation of said column relative to said vessel.

13. The mobile undersea habitat in accordance with claim 12 wherein there is included means to admit water to said ballast chamber and means to expel water from said ballast chamber to achieve the desired buoyancy.

14. The mobile undersea habitat in accordance with claim 12 wherein said habitat is provided by a cluster of interconnected spheroidal elements.

15. The mobile undersea habitat in accordance with claim 14 wherein there is included a gallery at said upper end of said habitat and said second end of said conduit for access to said conduit from a plurality of said interconnected spheroidal elements.

16. The mobile undersea habitat in accordance with claim 1 wherein said habitat includes a diving bell access hatch.

17. The mobile undersea habitat in accordance with claim 1 wherein there are included cables connected between said hull and said column adjacent said habitat to provide means for retracting said column into said hull opening, and winches to pay out and retrieve said cables.

18. The mobile undersea habitat in accordance with claim 1 wherein there are included emergency supply tanks on said column adjacent said habitat for supply of breathable gas thereto.

19. The mobile undersea habitat in accordance with claim 1 wherein the spacing between said structural and support pivot means at said first ends of said structural member and support member is substantially the same as the spacing between said platform and habitat pivot means at said second ends of said structural and support members, said structural and support members define the sides of a paral lelogram to maintain the platform portion and said habitat in a horizontal attitude.

20. The mobile undersea habitat in accordance with claim 1 wherein said structural member pivot means to said hull is spaced horizontally and upwardly from said support member pivot means.

* * * * *